US009631457B2

(12) United States Patent
Steele

(10) Patent No.: US 9,631,457 B2
(45) Date of Patent: Apr. 25, 2017

(54) GRAVITY-BASED CASING ORIENTATION TOOLS AND METHODS

(71) Applicant: Halliburton Energy Services, Inc., Houston, TX (US)

(72) Inventor: David Joe Steele, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 251 days.

(21) Appl. No.: 14/389,874

(22) PCT Filed: Dec. 16, 2013

(86) PCT No.: PCT/US2013/075435

§ 371 (c)(1),
(2) Date: Oct. 1, 2014

(87) PCT Pub. No.: WO2015/094163

PCT Pub. Date: Jun. 25, 2015

(65) Prior Publication Data

US 2016/0017689 A1 Jan. 21, 2016

(51) Int. Cl.

| | |
|---|---|
| ***E21B 47/024*** | (2006.01) |
| ***E21B 34/12*** | (2006.01) |
| ***E21B 33/13*** | (2006.01) |
| ***E21B 47/022*** | (2012.01) |
| ***E21B 33/124*** | (2006.01) |

(Continued)

(52) U.S. Cl.

CPC ..... *E21B 34/12* (2013.01); *E21B 33/124* (2013.01); *E21B 33/13* (2013.01); *E21B 33/14* (2013.01); *E21B 47/02232* (2013.01); *E21B 47/06* (2013.01)

(58) Field of Classification Search

CPC ... E21B 47/024; E21B 21/10; Y10T 137/0923
See application file for complete search history.

(56) References Cited

U.S. PATENT DOCUMENTS 1,854,208 A * 4/1932 Lynch ..... E21B 47/024 137/45
1,908,762 A * 5/1933 Johnston ..... E21B 21/10 137/45

(Continued)

OTHER PUBLICATIONS

International Search Report and Written Opinion for PCT/US2013/075435 dated Sep. 15, 2014.

*Primary Examiner* — Kipp Wallace
(74) *Attorney, Agent, or Firm* — McDermott Will & Emery LLP

(57) ABSTRACT

Disclosed are systems and methods of orienting wellbore tubulars using gravity. Some disclosed orientation indicating devices include a housing defining a first flow channel and being arrangeable within a wellbore tubular, an orientor movably arranged within the housing and defining a second flow channel in fluid communication with the first flow channel, and an eccentric weight arranged within the orientor and having a center of mass radially offset from a rotational axis of the orientor, the eccentric weight being configured to maintain the orientor pointing in one direction as the housing and the wellbore tubular are rotated, wherein, as the housing rotates, the first and second flow channels become progressively aligned or misaligned.

21 Claims, 8 Drawing Sheets

(51) Int. Cl.
*E21B 33/14* (2006.01)
*E21B 47/06* (2012.01)

(56) References Cited

U.S. PATENT DOCUMENTS

| | | | | |
|---|---|---|---|---|
| 3,096,823 | A * | 7/1963 | Crowe | E21B 23/006 166/131 |
| 4,351,116 | A | 9/1982 | Scott, Jr. | |
| 5,964,294 | A | 10/1999 | Edwards et al. | |
| 7,334,596 | B1 * | 2/2008 | Chesters | F16K 17/363 137/38 |
| 8,091,246 | B2 | 1/2012 | Hepburn | |
| 8,186,259 | B2 | 5/2012 | Burleson et al. | |
| 2002/0003040 | A1 | 1/2002 | Brunet | |
| 2002/0185315 | A1 * | 12/2002 | McLoughlin | E21B 47/024 175/76 |
| 2007/0227780 | A1 * | 10/2007 | MacPherson | E21B 21/08 175/320 |
| 2009/0084536 | A1 | 4/2009 | Kenison et al. | |
| 2011/0266001 | A1 * | 11/2011 | Dykstra | E21B 43/12 166/319 |
| 2012/0305313 | A1 | 12/2012 | DiFoggio | |

* cited by examiner

GRAVITY-BASED CASING ORIENTATION TOOLS AND METHODS

BACKGROUND

The present disclosure is related to wellbore equipment and, more particularly, to systems and methods of orienting wellbore tubulars using gravity.

In the oil and gas industry, hydrocarbons can be produced through relatively complex wellbores traversing one or more subterranean formations. Some wellbores can be multilateral wellbores, where one or more lateral wellbores extend from a parent (or main) wellbore. Multilateral wellbores often include one or more windows or casing exits provided on downhole wellbore tubulars that allow corresponding lateral wellbores to be formed. In order to accurately orient a multilateral window within the wellbore, measuring while drilling (MWD) tools or other common pressure-pulsing orientation indicating devices have been used. At increased depths, however, pressure pulses generated by conventional MWD tools become increasingly attenuated when the return flow path is restricted, such as in an annulus between an inner work string and an outer casing or liner string. As a result, a significant amount of pressure noise can be introduced into the system due to varied restrictions to flow in the return flow path. These conditions make the data transmitted by pressure pulses difficult to detect and interpret at a surface location.

Typical MWD tools also cannot be cemented through and they are too valuable to be drilled through. In addition, MWD tools do not provide for passage of plugs therethrough for releasing running tools, setting hangers and packers, etc. Moreover, if an MWD tool must be separately conveyed and retrieved from a well, additional time and expense are required for these operations. In addition, conveyance of MWD tools into very deviated or horizontal wellbores by wireline or pumping the tools downhole presents a variety of additional technical difficulties.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to wellbore equipment and, more particularly, to systems and methods of orienting wellbore tubulars using gravity.

The embodiments disclosed herein provide a means for angularly orienting various downhole tools or structures using fluid pressure measurements. An orienting indicating device is disclosed that includes a flow passage and an orientor that provides an eccentric weight rotatably mounted therein. A well operator may rotate the casing string from a surface location and thereby rotate the orienting indicating device. As the orienting indicating device rotates, the eccentric weight freely rotates and maintains the orientor pointing to the high side of the well while simultaneously varying the flow rate through the flow passage. Upon observing a predetermined pressure differential across the orienting indicating device, the well operator may know that a particular downhole tool or structure associated with the casing string has been properly oriented in the wellbore.

The presently disclosed embodiments may be particularly useful in angularly orienting a window used in the creation of a multilateral wellbore. It will be appreciated, however, that other downhole tools and structures may equally be oriented such as, but not limited to, latch couplings and alignment devices. The presently described orienting indicating device may prove useful in reducing rig time by saving trip time downhole. In some cases, for instance, the orienting indicating device may save two trips downhole.

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface relative to a wellbore, and "below", "lower", "downward" and similar terms refer to a direction away from the earth's surface relative to the wellbore.

Figure 1:
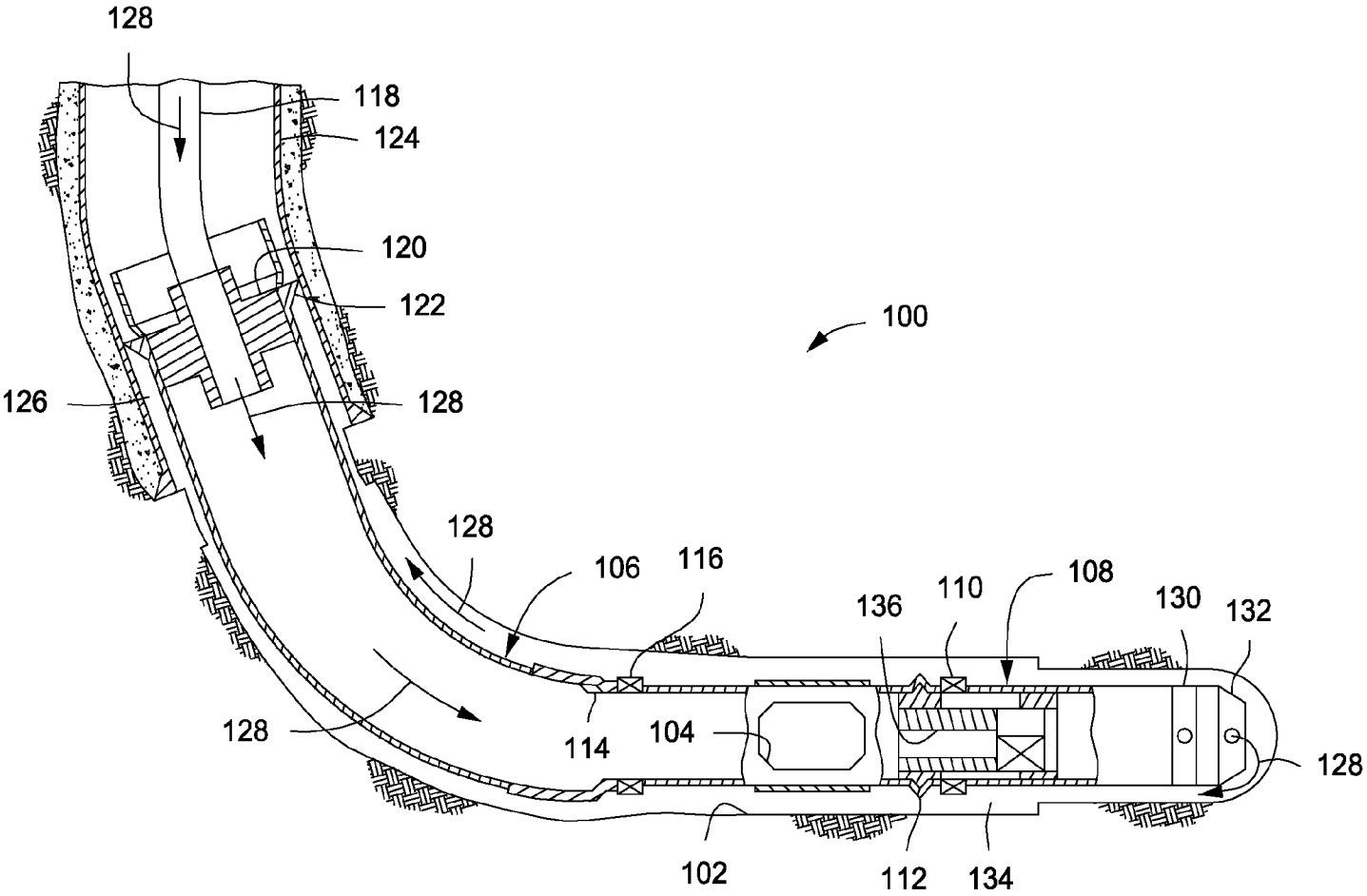
FIG. 1 illustrates a cross-sectional view of an exemplary well system that may embody principles of the present disclosure, according to one or more embodiments.

Referring to FIG. 1, illustrated is an exemplary well system 100 that may employ the principles of the present disclosure, according to one or more embodiments. As discussed herein, the well system 100 (hereafter "the system 100") may be used for indicating the real-time downhole orientation of a downhole tool or structure in a wellbore 102. In some embodiments, for example, the downhole tool or structure may be a window 104 used in drilling a branch wellbore (not shown) that intersects the main wellbore 102. As will be discussed below, however, orientation of other downhole tools and/or structures may be achieved using the system 100 without departing from the principles of the present disclosure.

In the system 100, it is desired to azimuthally orient the window 104 relative to the wellbore 102. As depicted in FIG. 1, the wellbore 102 extends from a substantially vertical portion to a substantially horizontal portion and the window 104 is depicted as being generally arranged within or otherwise extended to the horizontal portion thereof. The desired orientation of the window 104 in this example is vertically upward relative to the wellbore 102 or, in other words, to the "high side" of the wellbore 102. The window 104 is interconnected in or with a wellbore tubular 106, such as a liner string, a casing string, or any other type of tubular, pipe, or conduit known to those skilled in the art to be extendable into a wellbore 102. In operation, the wellbore tubular 106 is angularly rotated within the wellbore 102 until the window 104 is properly oriented therein (i.e., toward the high side).

The system 100 may also include an orientation indicating device 108 interconnected within or otherwise forming an integral part of the wellbore tubular 106. As discussed herein, the orientation indicating device 108 (hereafter "the device 108") may be used to orient the window 104 (or any other downhole tools and/or structures) to a desired angular orientation, such as to the high side of the wellbore 102. However, it should be understood that the window 104 may be oriented to other angular orientations other than vertical in keeping with the principles of the present disclosure. For example, the window 104 could be oriented in a downward direction or any other angular direction with respect to the wellbore 102, if desired. Briefly, this may be accomplished by adjusting an azimuthal alignment between the window 104 and the device 108.

In the illustrated embodiment of FIG. 1, the azimuthal alignment may be accomplished prior to conveying the wellbore tubular 106 into the wellbore 102 by means of one or more alignment devices 110. As illustrated, the alignment device 110 may also be interconnected within or otherwise forming an integral part of the wellbore tubular 106. While not particularly illustrated, in some embodiments, the alignment device 110 may be axially interconnected between the window 104 and the device 108. As will be appreciated, however, adjustment of the azimuthal alignment between the device 108 and any downhole tool or structure to be oriented in the wellbore 102 can be accomplished by other means, as well. For instance, adjustment of the azimuthal alignment between the device 108 and any downhole tool or structure may be accomplished through the use of an alignment adjusting device forming part of the device 108 itself, or as part of the downhole tool or structure to be oriented, etc.

As indicated above, various downhole tools or structures other than the window 104 may additionally, or alternatively, be oriented relative to the wellbore 102 through use of the presently described device 108. For example, another structure that may be oriented with respect to the wellbore 102 may be a latch profile 112 used to anchor and orient a whipstock (not shown) that may be subsequently installed in the wellbore tubular 106. As known in the art, the whipstock may be used to deflect one or more mills or drill bits through the window 104 in order to drill a lateral or branch wellbore that extends from the main wellbore 102. The device 108 may be configured to axially traverse and otherwise encompass the latch profile 112 and thereby protect it from the accumulation of debris, cement, or other obstructions that would otherwise prevent the whipstock from properly securing or attaching thereto.

Yet another downhole tool or structure that may be oriented with respect to the wellbore 102 may be an alignment tool 114. The alignment tool 114 may be used to orient and position subsequently-installed completion equipment relative to the window 104, the wellbore 102 and/or the wellbore tubular 106. Another type of alignment device 116 may be used to azimuthally orient the alignment tool 114 relative to the device 108 and the window 104 and/or the latch profile 112 prior to, or during, installation of the wellbore tubular 106 in the wellbore 102.

As depicted in FIG. 1, a tubular work string 118 may be used to convey the wellbore tubular 106 into the wellbore 102. At a lower end of the work string 118 is a setting tool 120 used to set a liner hanger 122 at an upper end of the wellbore tubular 106. A liner or casing string 124 may be installed in the wellbore 102 above the liner hanger 122 and cemented therein. The casing string 124 may extend to a surface location.

Prior to sealing off an annulus 126 between the liner hanger 122 and the casing string 124, a fluid 128, such as drilling fluid, brine, or another circulation fluid, may be introduced into the wellbore tubular 106. The fluid may be circulated through the work string 118, through the wellbore tubular 106, through a cementing float valve 130 and out a casing shoe 132 at a lower end of the wellbore tubular 106. The fluid 128 may exit the casing shoe 132 into an annulus 134 defined between the wellbore tubular 106 and the wellbore 102 and may return to the surface location via the annulus 126. For reasons discussed in greater detail below, the device 108 may be configured to be the most fluidly restrictive portion of the above-described circulation path for the fluid 128. As illustrated, for example, the device 108 may provide or otherwise define a flow passage 136 that extends therethrough and otherwise places portions of the wellbore tubular 106 above and below the device 108 in fluid communication.

While the fluid 128 is being circulated through the wellbore tubular 106, a relative pressure differential across the device 108 through the flow passage 136 can be monitored or otherwise observed at a remote location, such as at a drilling rig. For example, one or more pressure gauges or sensors (not shown) located on the earth's surface or on a subsea wellhead may be used to detect pressure applied to the work string 118 and pressure in the casing string 124 at the drilling rig. The measured pressure differential may be useful in determining when the window 104 (or the latch coupling 112 or the alignment tool 114) is at or near a predetermined or desired angular orientation within the wellbore 102.

In exemplary operation, a decrease in the pressure differential across the device 108 at a certain rate of flow of the fluid 128 is observed at the surface location as an indication that a desired azimuthal orientation of the window 104 (or the latch coupling 112 or the alignment tool 114) has been achieved with respect to the wellbore 102. The work string 118 is used to rotate the wellbore tubular 106 in the wellbore 102 until the reduced pressure differential is observed, at which point the rotation of the wellbore tubular 106 may be ceased. In some embodiments, once the reduced pressure differential is observed, the wellbore tubular 106 may be further rotated a predetermined amount in order to achieve a certain predetermined orientation of the window 104 (or the latch coupling 112 or the alignment tool 114). As will be appreciated, the predetermined amount of rotation would most likely be determined by a change in pressure, since twisting in long tubulars makes it an unreliable method of orienting tools. In other words, 90° of rotation at the surface will not necessarily provide any certain orientation at the window 104. Instead, the pressure may be monitored to determine when the proper angular orientation is met.

Advantageously, the fluid 128 may be continuously pumped through the wellbore tubular 106 and the work string 118 while the wellbore tubular 106 is being rotated and the pressure differential is monitored at the surface location. Continuously pumping or circulating the fluid 128 may help prevent the wellbore tubular 106 and the work string 118 from becoming stuck within the wellbore 102. More particularly, the fluid 128 coursing through the annuli 126, 134 toward the surface location may provide a type of hydrostatic bearing that allows the wellbore tubular 106 and the work string 118 to freely rotate with respect to the wellbore 102, even in severely deviated portions thereof.

Moreover, by continuously pumping the fluid 128 and rotating the wellbore tubular 106 via the work string 118, trapped torque can be monitored continuously. For instance, if the wellbore tubular 106 rotates a small angular amount after the final adjustment has been made, such small rotation may be observed at the surface by a change in the stand pipe pressure. When this is observed, the wellbore tubular 106 and the work string 118 may be re-oriented to the correct angular orientation, if necessary.

Figure 2:
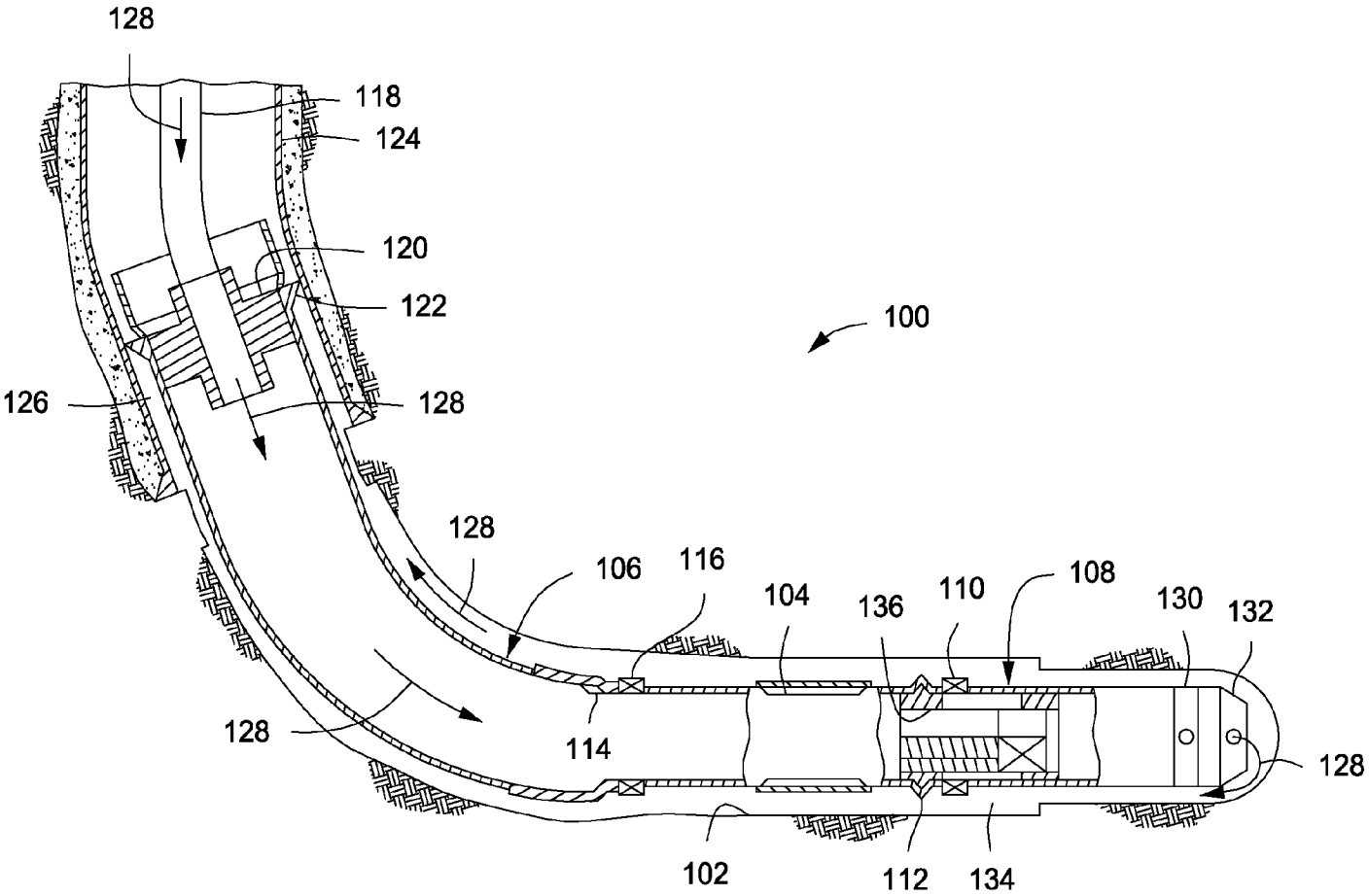
FIG. 2 illustrates a cross-sectional view of the well system of FIG. 1 during exemplary operation, according to one or more embodiments.

Referring now to FIG. 2, with continued reference to FIG. 1, the system 100 is representatively illustrated after the wellbore tubular 106 has been rotated to the desired angular orientation of the window 104 while the fluid 128 is continuously circulated through the wellbore tubular 106. In this configuration, the flow area of the flow passage 136 extending through the device 108 is significantly increased. As a result, the pressure differential of the fluid 128 across the device 108 is significantly reduced while flowing at the same flow rate as initially introduced in the configuration depicted in FIG. 1. As indicated above, this reduced pressure differential may be observed at the remote surface location as a positive indication that the desired angular orientation of the window 104 has been achieved.

In other embodiments, however, the reduced pressure differential may indicate that other downhole tools or structures, such as the latch coupling 112 and/or the alignment tool 114, are at corresponding desired orientation(s). In yet other embodiments, the reduced pressure differential may indicate that all of the desired downhole tools or structures are at their corresponding desired orientations. In FIG. 2, for example, all of the structures 104, 112, 114 are depicted as being at a desired angular orientation when the pressure differential across the device 108 is reduced.

The increased flow area of the flow passage 136 not only contributes to the reduced pressure differential observed across the device 108, but also provides other benefits in the system 100. For example, the increased flow area permits a cement slurry, including any larger pebbles or chunks associated therewith, to be freely flowed through the device 108. Thus, the device 108 does not have to be removed from the wellbore tubular 106 or drilled through prior to cementing the wellbore tubular 106 in the wellbore 102. Those skilled in the art will readily recognize this as a significant operational and time-saving benefit of the system 100. Furthermore, the increased flow area through the device 108 can permit objects, such as plugs, balls, etc., to pass through the device in order to actuate tools below the device 108, if needed.

Figure 3:
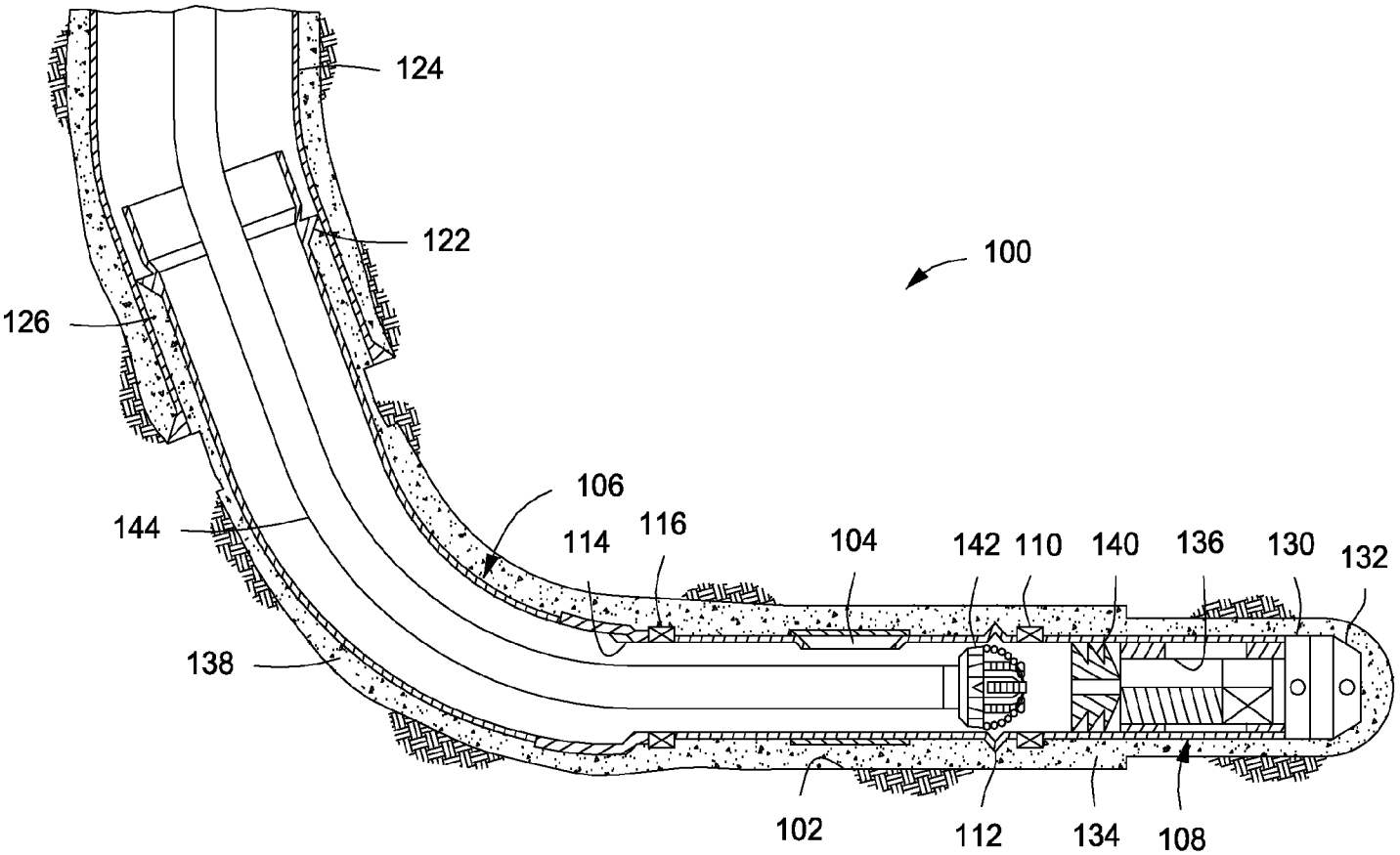
FIG. 3 illustrates a cross-sectional view of the well system of FIG. 1 following a cementing operation and during a subsequent drilling operation, according to one or more embodiments.

Referring now to FIG. 3, with continued reference to FIGS. 1 and 2, the system 100 is representatively illustrated following a cementing operation, according to one or more embodiments. As illustrated, cement 138 is now present in the annuli 126 and 134, and the liner hanger 122 has thereby been permanently set in the casing string 124. It should be noted that the cement 138 has been flowed through the device 108, without requiring removal of the device from the wellbore tubular 106. Through the use of one or more cement wiper plugs 140 and associated balls (not shown), the device 108 has been removed from its attachment with the wellbore tubular 106 and advanced to the bottom of the wellbore tubular 106 to engage the cementing valve 130.

More particularly, the cement wiper plugs 140 may be associated with the liner hanger 122. Upon introducing an appropriately sized ball into the work string 118 (FIGS. 1 and 2), a lower wiper plug 140 may be pumped off the liner hanger 122 and through the wellbore tubular 106 with a slurry of the cement 138 until engaging the device 108. The cement 138 may be pumped through the device 108 until a proper amount of cement 138 is pumped into the annuli 126, 134. At that point, another ball (not shown) may be dropped with a displacement fluid configured to shear release a top wiper plug 140 from the liner hanger 122. The top wiper plug 140 is pumped to the device and lands on top of the lower wiper plug 140. Increasing the hydraulic pressure of the displacement fluid within the wellbore tubular 106 may result in the shearing or failure of one or more securing devices (not shown) associated with the device 108, thereby freeing the device 108 so that it may be advanced downhole until coming into contact with the cementing valve 130.

Following the cementing operation, as depicted in FIG. 3, a drill bit 142 may be conveyed into the wellbore tubular 106 on a drill string 144 and used to drill through the device 108 (including the wiper plugs 140), the cementing valve 130, and the casing shoe 132 in order to extend the wellbore 102. The internal components of the device 108 may be made of relatively drillable and non-magnetic materials (such as aluminum, elastomers, plastics, composites, etc.), so that extension of the wellbore 102 can be readily accomplished, and so that the resulting debris can be readily circulated out of the wellbore 102.

Figure 4:
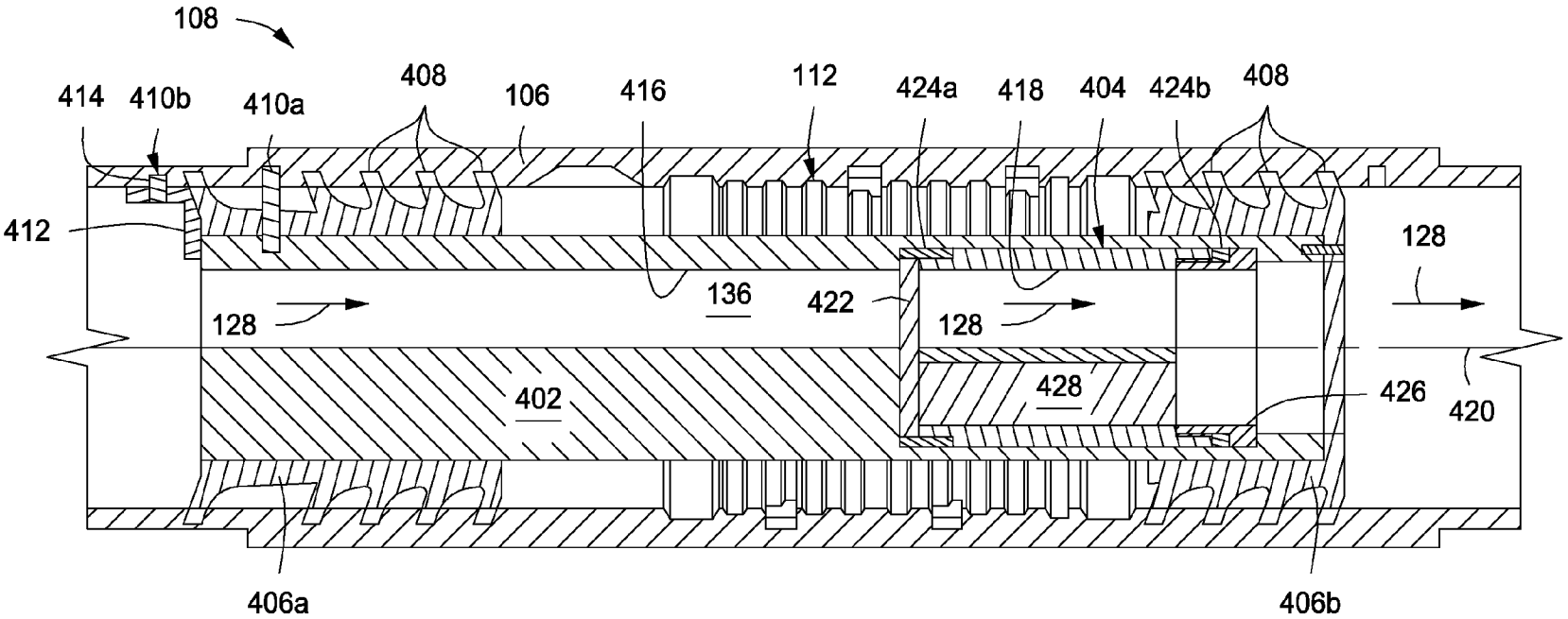
FIG. 4 illustrates an enlarged cross-sectional view of the orientation indicating device of FIGS. 1-3, according to one or more embodiments.

Referring now to FIG. 4, illustrated is an enlarged cross-sectional view of the orientation indicating device 108, according to one or more embodiments. Like numerals used in FIG. 4 that have been used in prior figures represent like components not described again in detail. As illustrated, the device 108 may include a housing 402 and an orientor 404 movably arranged within the housing 402. The housing 402 may be an elongate, substantially cylindrical member secured within the wellbore tubular 106 at or adjacent the latch profile 112. The housing 402 may be made of a material that is easily milled or drilled, such that it may be easily drilled through as described in FIG. 3 above. In at least one embodiment, for example the housing 402 may be made of aluminum. In other embodiments, the housing 402 may be made of a composite material.

The latch profile 112 may exhibit a specific profile or design configured to mate with a latch on the bottom of a whipstock device (not shown). The latch coupling 112 may be angularly aligned with the window 104 (FIGS. 1-3) so that when the subsequently conveyed whipstock lands on the latch coupling 112 and is rotated to lock it into place, it will be pointing in the correct angular direction to properly guide any mills and/or drill bits out of the window 104. During the cementing operation discussed above, however, cement particulates and other debris oftentimes become lodged in the profiles of the latch coupling 112 and the cement could harden therein. As a result, when the whipstock is conveyed downhole, its associated latch may have difficulty locating and securing the whipstock to the latch coupling 112.

According to the present disclosure, however, the device 108 may be configured to axially encompass or otherwise cover the latch coupling 112 and thereby serve as a barrier that substantially prevents any debris and/or cement from lodging in the profiles of the latch coupling 112. As will be appreciated, such a barrier will allow the whipstock to properly locate and secure itself to the latch coupling 112 without being obstructed by debris and/or cement.

To help accomplish this, each end of the housing 402 may be secured in the wellbore tubular 106 using corresponding sealing devices, shown as an upper sealing device 406*a* and a lower sealing device 406*b*. The upper and lower sealing devices 406*a,b* may be configured to isolate the latch profile 112 during operation, especially during the cementing operation described above. To accomplish this, the upper and lower sealing devices 406*a,b* may be made of a flexible material that may engage and seal against the inner wall of the wellbore tubular 106. In some embodiments, the upper and lower sealing devices 406*a,b* may be wiper plugs that provide or otherwise define a series of wipers 408 configured to sealingly engage the inner wall of the wellbore tubular 106. The wipers 408 may be configured to provide a seal against the inner wall of the wellbore tubular 106, but also allow a small amount of pressurized fluid to escape once downhole. For example, the device 108 is assembled while at the surface at atmospheric pressure and, upon locating the device 108 downhole, a large pressure differential may be generated by the air trapped between the axially adjacent sealing devices 406*a,b*. Since the wipers 408 are semi-flexible, the trapped air is able to escape axially through the wipers 408 in order to equalize the pressure and thereby prevent a potential hydrostatic lock on the device 108.

In other embodiments, the wipers 408 may be replaced with one or more swab cups or the like. In yet other embodiments, the upper and lower sealing devices 406*a,b* may include one or more O-rings configured to provide a seal that substantially isolates the latch profile 112.

The housing 402 may further be secured within the wellbore tubular 106 using one or more securing devices 410, shown as a first securing device 410*a* and a second securing device 410*b*. One or both of the first and second securing devices 410*a,b* may be configured to axially and rotationally secure the housing 402 within the wellbore tubular 106 as the device 108 is being run into the wellbore 102 (FIGS. 1-3). Accordingly, the first and/or second securing devices 410*a,b* may be installed on the housing 402 in conjunction with the one or more alignment devices 110, 116 (FIGS. 1-3) and used to help azimuthally align the device 108 with one or more of the downhole tools or structures (i.e., the window 104, the profile 112, and/or the alignment tool 114 of FIGS. 1-3) to be oriented in the wellbore 102.

The first securing device 410*a* may be a releasable device or mechanism, such as a shear pin, a shear ring, or any like device configured to shear or otherwise fail upon assuming a predetermined axial load. As indicated above, the predetermined axial load may be applied through the use of one or more cement wiper plugs 140 (FIG. 3). Once the first securing device 410*a* fails, the device 108 may be free to axially and radially translate within the wellbore tubular 106.

The second securing device 410*b* may include or otherwise encompass a tab 412 secured to the housing 402 and a releasable device 414, such as a shear pin or shear ring, that secures the tab 412 to the wellbore tubular 106. Similar to the first securing device 410*a*, the shear pin or ring 414 may be configured to shear or otherwise fail upon assuming the predetermined axial load provided by the cement wiper plug 140 (FIG. 3). In other embodiments, the tab 412 may be configured to fail upon assuming the predetermined axial load. In such embodiments, the tab 412 may be made of a soft material, such as brass, mild steel, etc., and when the cement wiper plug 140 engages the device 108 with the predetermined axial load, the tab 412 may be configured to break in tension.

The housing 402 may further define or otherwise provide a first flow channel 416 that fluidly communicates with a second flow channel 418 defined longitudinally through the orientor 404. The flow passage 136 through the device 108 may be provided through the combination of the first and second flow channels 416. When the first and second flow channels 416, 418 are substantially aligned, the flow area of the flow passage 136 is increased and the pressure differential of the fluid 128 as measured at the surface is correspondingly decreased. In some embodiments, as discussed above, such a decrease in pressure differential may be a positive indication that the desired angular orientation of the window 104 (FIGS. 1-3) has been achieved.

In other embodiments, however, a decrease in pressure differential may be an indication that the desired angular orientation of the window 104 has not been reached. In such embodiments, an increase in pressure differential may instead provide the positive indication that the desired angular orientation of the window 104 has appropriately been reached, without departing from the scope of the disclosure.

The orientor 404 may be secured within the housing 402 such that it is able to freely rotate about a rotational axis 420. More particularly, the orientor 404 may include one or more bushings or bearings that secure the orientor 404 against axial movement, but simultaneously allow rotation about the rotational axis 420. In the illustrated embodiment, for example, the orientor 404 may include at least one thrust bearing 422 and one or more radial bearings 424 (shown as first and second radial bearings 424*a* and 424*b*). The thrust bearing 422 may be configured to secure the orientor 404 against axial loads and otherwise allow the orientor 404 to rotate about the rotational axis 420 while axially engaging the housing 402. While depicted in FIG. 4 as being at the uphole end of the orientor 404, those skilled in the art will readily appreciate that the thrust bearing 422 may equally be placed at the downhole end of the orientor 404, without departing from the scope of the disclosure.

The radial bearings 424*a,b* operate to allow the orientor to rotate about the rotational axis 420 while radially engaged with the housing 402. In some embodiments, a retaining ring 426 may interpose the orientor 404 and the housing 402 at the downhole end of the orientor 404. The retaining ring 426 may be configured to secure the second radial bearing 424*b* in the orientor 404 and otherwise hold the orientor 404 in place axially. Moreover, the retaining ring 426 may be configured to facilitate the movable engagement of the orientor 404 to the housing 402.

The bearings 422, 424*a,b* may be made of a material that is easily drillable, such that they may be easily drilled through as described in FIG. 3 above. For example, the bearings 422, 424*a,b* may be made, but are not limited to, tin, bronze, tin bearing bronze, brass, copper, aluminum, plastics (e.g., TEFLON® coated or impregnated PEEK), glass filled TEFLON®, composite materials, ceramics, coated ceramics, or any combination thereof. In other embodiments, the bearings 422, 424*a,b* may be made of any material that is easily machined, but also strong and otherwise resistant to wear.

In at least one embodiment, one or all of the bearings 422, 424*a,b* may be a fluid bearing, such as a fluid dynamic bearing or a hydrostatic bearing. In such embodiments, fluid pressure from above the orientor 404 may be applied to the lower end of the orientor 404 to reduce the thrust force due to the differential pressure. Likewise, the fluid pressure above the orientor 404 could be used to provide a fluid cushion around the outer diameter of the orientor 404. In other embodiments, a dedicated reservoir (not shown) of oil or other hydraulic fluid may be included in the device 108 and otherwise configured to provide the fluid bearing(s) with the required friction-reducing fluid to properly operate. In such embodiments, the fluid pressure from drilling mud or cement may serve to compress or otherwise maintain the reservoir oil in its appropriate locations in the fluid bearing (s).

As will be appreciated, the arrangement of the bearings 422, 424*a,b* shown in FIG. 4 is merely one example of reducing the friction between the orientor 404 and the housing 402, and therefore should not be considered as limiting to the present disclosure. Those skilled in the art will readily recognize several variations in where the bearings 422, 424*a,b* may be arranged or otherwise placed, and equally obtain the same friction-reducing results.

The orientor 404 may further include an eccentric weight 428. The eccentric weight 428 is "eccentric" in that its weight is radially offset from the rotational axis 420 about which the orientor 404. In this embodiment, the rotational axis 420 also corresponds to an axis of rotation of the wellbore tubular 106 in the wellbore 102. Since the center of mass of the eccentric weight 428 is radially offset from the rotational axis 420, it will be constantly biased by gravitational force to its lowest position relative to the axis of rotation 420. Thus, in deviated wellbores, the eccentric weight 428 will constantly seek a lowermost position in the device 108, regardless of the azimuthal orientation of the device 108 and the wellbore tubular 106.

Figure 5A:
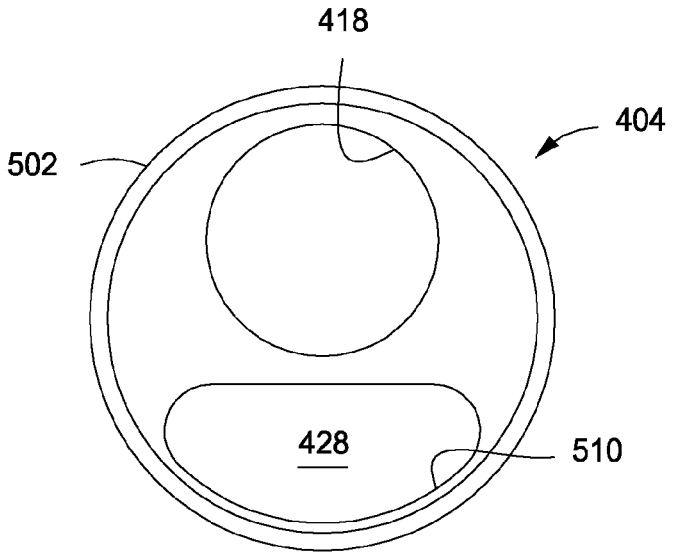
FIGS. 5A and 5B illustrate end and isometric views, respectively, of the orientor of FIG. 4, according to one or more embodiments.
Figure 5B:
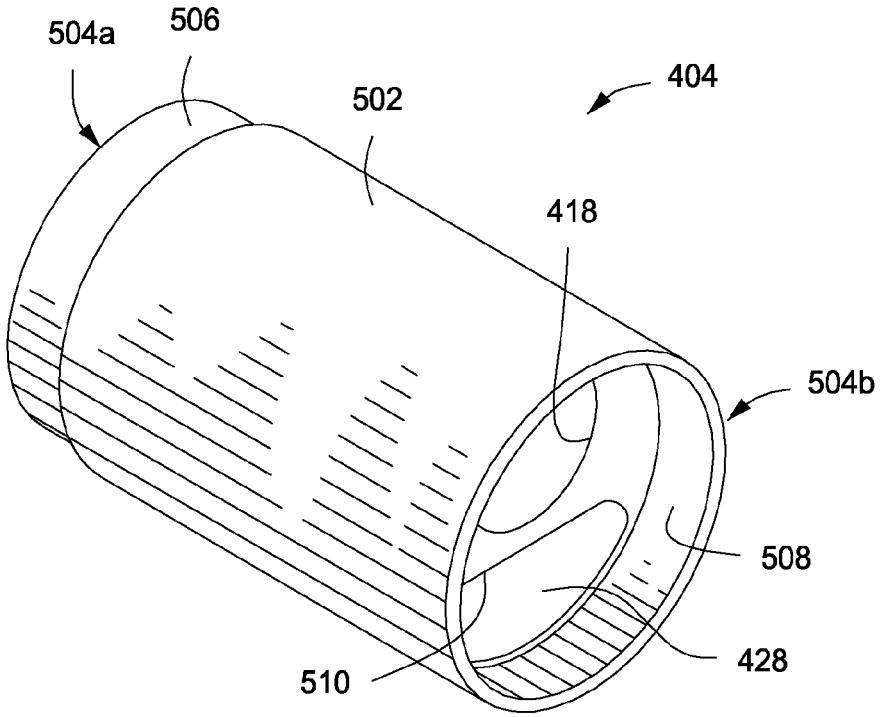

Referring briefly to FIGS. 5A and 5B, with continued reference to FIG. 4, illustrated are end and isometric views, respectively, of the orientor 404, according to one or more embodiments. As illustrated, the orientor 404 includes a generally cylindrical body 502 having a first end 504*a* and a second end 504*b*. FIG. 4B depicts a view of the second end 504*b* of the body 502. The first end 502*a* may have a radial shoulder 506 defined therein and configured to accommodate portions of one or both of the thrust bearing 422 and the first radial bearing 424*a* of FIG. 4. The second end 504*b* may define an annular channel 508 configured to receive the retaining ring 426 and portions of the second radial bearing 424*b*.

The body 502 may further define or provide the second flow channel 418 and a compartment 510 configured to receive and otherwise retain the eccentric weight 428 therein. The body 502 may be made of an easily drillable material that is capable of not eroding or corroding during operations. In at least one embodiment, the body 502 may be made of aluminum or any material that is light weight, fairly erosion-resistant and corrosion-resistant. In some embodiments, the body 502 may be coated or anodized to increase its wear and corrosion-resistance and otherwise reduce friction.

The eccentric weight 428 may be inserted into or otherwise disposed within the compartment 510 and configured to ensure that the orientor 404 remains oriented with the Earth's gravitational field. By doing so, the second flow channel 418 may constantly be moved or otherwise positioned high side of the wellbore 102 (FIGS. 1-3). The eccentric weight 428 may be made of a high-density, easily drillable material. In some embodiments, for instance, the eccentric weight 428 may be made of free cutting brass, which possesses good machining properties and has a high-density (e.g., greater than that of aluminum, which the body 502 may be made of).

Referring again to FIG. 4, with continued reference to FIGS. 1-3, exemplary operation of the device 108 is now provided. Since the device 108 is the most flow restrictive element in the circulation flow path of the fluid 128, any changes to the pressure differential across the device 108 may be observable at a remote location. For example, the difference between the pressure applied at the surface to circulate the fluid 128 at a certain flow rate, and the pressure in the return flow path of the fluid 128 at the surface can be readily monitored for changes in the pressure differential. As will be readily appreciated by those skilled in the art, greater applied pressure will be required to circulate the fluid 128 at a certain flow rate when the flow area through the flow passage 136 is more restricted. On the other hand, less applied pressure will be required to circulate the fluid 128 at the same flow rate when the flow area through the flow passage 136 is less restricted.

Prior to introducing the device 108 downhole, the device 108 may be azimuthally aligned with the window 104 for which indication of orientation in the wellbore 102 is desired. In the present example, the first flow channel 416 would be oriented substantially with the window 104, since the indication of orientation is desired when the window is vertically upward relative to the wellbore 102. As a result, positive indication will be provided when gravity acts on the orientor 404 to align the first and second flow channels 416, 418 and thereby provide the greatest flow area for the flow passage 136.

This azimuthal alignment of the first flow channel 416 relative to the window 104 can be easily achieved using the alignment device 110 or any other suitable alignment device. Similarly, the first flow channel 416 can be azimuthally aligned with the latch coupling 112 or the alignment tool 114, if desired, using one of the alignment devices 110, 116.

Alternatively, if use of the alignment devices 110, 116 is not desired or available, a recording of the relative azimuthal orientation between the first flow channel 416 and the window 104 (or the latch coupling 112 and/or the alignment tool 114) can be made when the device 108 is interconnected in the wellbore tubular 106. In this manner, the orientation of the window 104 (or the latch coupling 112 and/or the alignment tool 114) will be known when the downward orientation of the first flow channel 416 is indicated by the reduced pressure differential across the device 108.

After the device 108 has been interconnected in the wellbore tubular 106 and the relative orientation between the first flow channel 416 and the window 104 (or the latch coupling 112 and/or the alignment tool 114) is suitably adjusted, or at least known, the wellbore tubular 106 is conveyed into the wellbore 102. Note that these steps may be performed concurrently, for example, if the length of the wellbore tubular 106 between the device 108 and the window 104 (or the latch coupling 112 and/or the alignment tool 114) is too great to permit them to be simultaneously installed in the well.

When the wellbore tubular 106 is at the desired depth in the wellbore 102, the fluid 128 may then be circulated at a certain flow rate, and the observed pressure differential is noted at the surface. As the fluid 128 circulates, the wellbore tubing 106 is rotated, which will either progressively open or close the flow passageway 136 as gravity acts on the eccentric weight 428 of the orientor 404 and the first and second flow channels 416, 418 rotate with respect to each other. More particularly, detecting an incremental decrease in the pressure differential across the device 108 as the wellbore tubular 106 is rotated would indicate that the first and second flow channels 416, 418 are gradually aligning and therefore moving the window 104 closer to the particular or desired orientation. On the other hand, an incremental increase in the pressure differential across the device 108 as the wellbore tubular 106 is rotated would indicate that the first and second flow channels 416, 418 are gradually moving out of alignment and therefore moving the window 104 farther from the particular or desired orientation. Accordingly, the magnitude of the pressure differential across the device 108 provides an indication of the amount by which the azimuthal orientation of the window 104 differs from the particular or desired azimuthal orientation.

In some embodiments, further rotation of the wellbore tubular 106 may be desired, for example, to achieve another azimuthal orientation of the window 104 (or the latch coupling 112 and/or the alignment tool 114). Further rotation of the wellbore tubular 106 may also be undertaken to compensate for stored torque in the wellbore tubular 106 or work string 118, or otherwise to compensate for friction between the wellbore 102 and the wellbore tubular 106 or the work string 118.

After the wellbore tubular 106 and the window 104 (or the latch coupling 112 and/or the alignment tool 114) have been properly oriented, the cement 138 can be flowed through the device 108, the cementing valve 130 and the float shoe 132, and subsequently into the annuli 126, 134.

To facilitate a better understanding of the present disclosure, the following example of a representative embodiment is given. In no way should the following example be read to limit, or to define, the scope of the disclosure.

For the present example, and with continued reference to FIGS. 1-4, the device 108 is used within the wellbore 102 to orient the window 104 to the high side of the wellbore 102. It is assumed that the device 108 will be installed in 9⅝ inch wellbore tubing 106 and the weight of the fluid 128 being circulated is 10 pounds per gallon. The circulation rate of the fluid 128 while orienting the window 128 to the high side will be approximately 6 barrels per minute (BPM), or 252 gallons per minute (GPM). Also, it is assumed that a detected pressure increase at the surface location (e.g., the standpipe pressure or pump pressure increase) of approximately 100 psi is to be obtained when the window 104 is properly oriented.

The pressure drop across the device 108 will be used to determine when the window 104 is within +/−30° from the high side of the wellbore 102. The equation to determine the pressure drop across the device 108 may be similar to the equation for pressure drop across a nozzle:

$$\Delta P = \frac{Q^2 \times \mathrm{MW}}{10858 \times TFA^2} \qquad \text{Equation (1)}$$

where ΔP is the pressure drop across the device 108, Q is the flow rate (in gallons per minute), MW is the mud weight (i.e., weight of the fluid 128) in pounds per gallon, and TFA is the total flow area in inches squared. While circulating, the only unknown to the operator would be the TFA, which can be determined by measuring the pressure drop at the surface. As the operator rotates the wellbore tubular 106 the fluctuation in the drill pipe pressure may be observed and recorded. When the TFA is minimized or otherwise choked, the pressure detected at the surface will get larger. On the other hand, when the TFA increases, the pressure detected at the surface will correspondingly decrease.

As indicated in Table 1 below, the flow rate is held constant at 6 BPM (252 GPM) and the mud weight is a constant 10 lbs/gallon. Together they illustrate that to get a pressure drop change from approximately 2 psi to approximately 100 psi (actual values are 1.99689 psi and 94.81378 psi) will require a TFA change of about 1.625 $in^2$ (2.625 $in^2$−1 $in^2$=1.625 $in^2$).

TABLE 1

| ΔP (psi) | Flow Rate (BPM) | Mud Weight (lbs/gal) | Diameter | TFA ($in^2$) | $TFA^2$ |
|---|---|---|---|---|---|
| 1517.021 | 6 | 10 | 0.5 | 0.1963495 | 0.038553 |
| 621.3716 | 6 | 10 | 0.625 | 0.3067962 | 0.094124 |
| 299.6584 | 6 | 10 | 0.75 | 0.4417865 | 0.195175 |
| 161.7481 | 6 | 10 | 0.875 | 0.6013205 | 0.361586 |
| 94.81378 | 6 | 10 | 1 | 0.7853982 | 0.61685 |
| 59.19178 | 6 | 10 | 1.125 | 0.9940196 | 0.988075 |
| 38.83573 | 6 | 10 | 1.25 | 1.2271846 | 1.505982 |
| 26.52532 | 6 | 10 | 1.375 | 1.4848934 | 2.204908 |
| 18.72865 | 6 | 10 | 1.5 | 1.7671459 | 3.122805 |
| 13.59747 | 6 | 10 | 1.625 | 2.073942 | 4.301236 |
| 10.10926 | 6 | 10 | 1.75 | 2.4052819 | 5.785381 |
| 7.671255 | 6 | 10 | 1.875 | 2.7611654 | 7.624034 |
| 5.925862 | 6 | 10 | 2 | 3.1415927 | 9.869604 |
| 4.649816 | 6 | 10 | 2.125 | 3.5465636 | 12.57811 |
| 3.699486 | 6 | 10 | 2.25 | 3.9760782 | 15.8092 |
| 2.980005 | 6 | 10 | 2.375 | 4.4301365 | 19.62611 |
| 2.427233 | 6 | 10 | 2.5 | 4.9087385 | 24.09571 |
| 1.99689 | 6 | 10 | 2.625 | 5.4118842 | 29.28849 |

Figure 6:
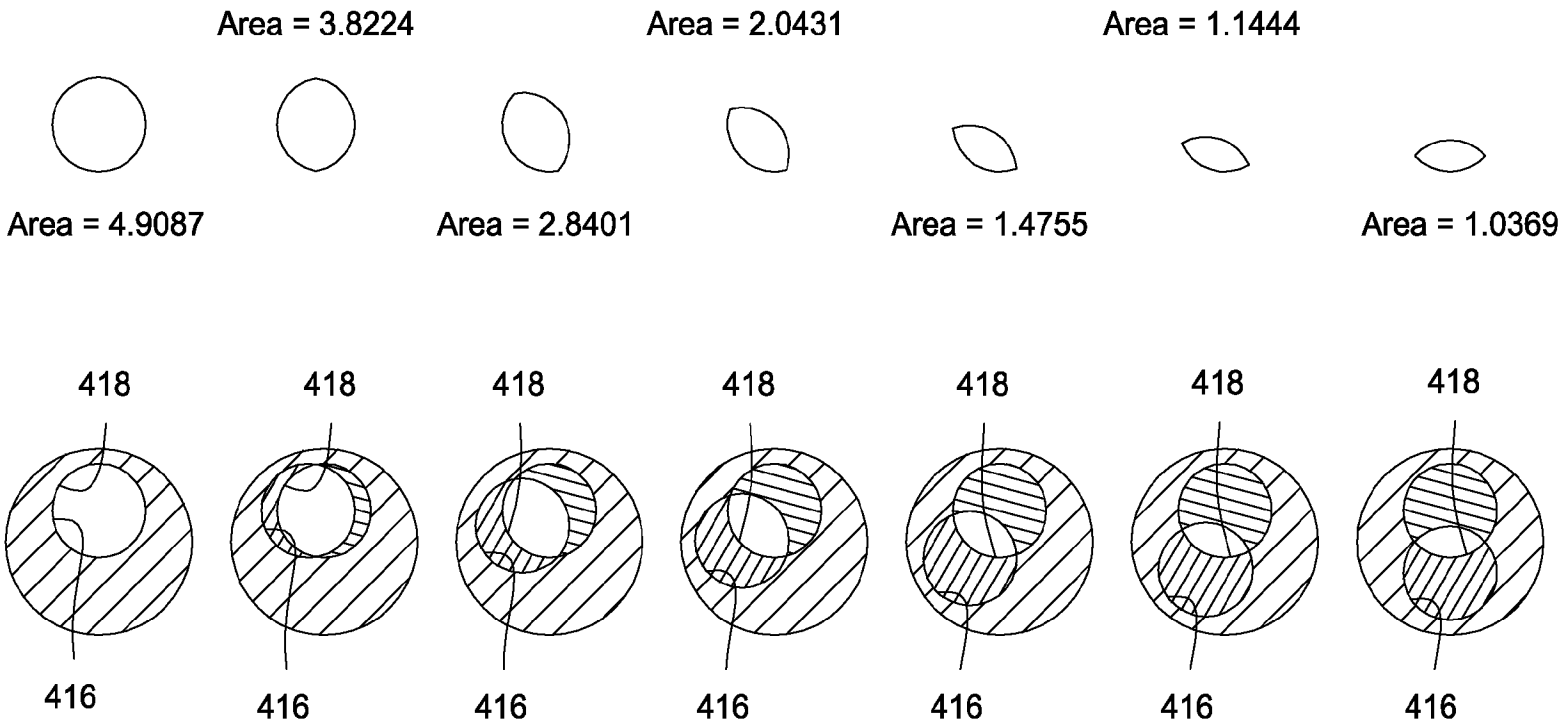
FIG. 6 illustrates progressive end views of the first and second flow channels of the exemplary orientor of FIG. 4 during orientation operations, according to one or more embodiments.

Referring additionally to FIG. 6, illustrated are progressive end views of the first and second flow channels 416, 418 during the example orientation operation, according to one or more embodiments. In the present example and embodiment, the second flow channel 418 of the orientor 404 may exhibit a radius of 2.5 inches, thereby providing a TFA commensurate with such a radius when the first and second flow channels 416, 418 are axially aligned. As generally described above, while the wellbore tubular 106 is rotated at the surface, the orientor 404 may be configured to pivot about its rotational axis 420 with respect to the wellbore tubular 106. The force of gravity on the eccentric weight 428 maintains the second flow channel 418 on the high side of the wellbore 102 as the wellbore tubular 106 is rotated.

Moving right to left in FIG. 6, it can be seen that the flow area (or TFA from Equation (1) above) progressively increases as the first flow channel 416 rotates away from the low side of the wellbore 102 (on the right) to facing the high side of the wellbore 102 (on the left), where it generally aligns with the second flow channel 418. When the first and second flow channels 416, 418 are misaligned by 180°, as shown at the right in FIG. 6, the resulting flow area is about 1.0369 $in^2$, which translates into a corresponding high pressure differential at the surface. However, when the first and second flow channels 416, 418 are axially aligned, as shown at the left in FIG. 6, the resulting flow area is about 4.9087 $in^2$, which translates into a corresponding low pressure differential at the surface. Based on Table 1 above, the pressure drop in such a scenario would reach about 90 psi, and the pressure drop across the device 108 would give a corresponding pressure increase response at the surface.

Figure 7:
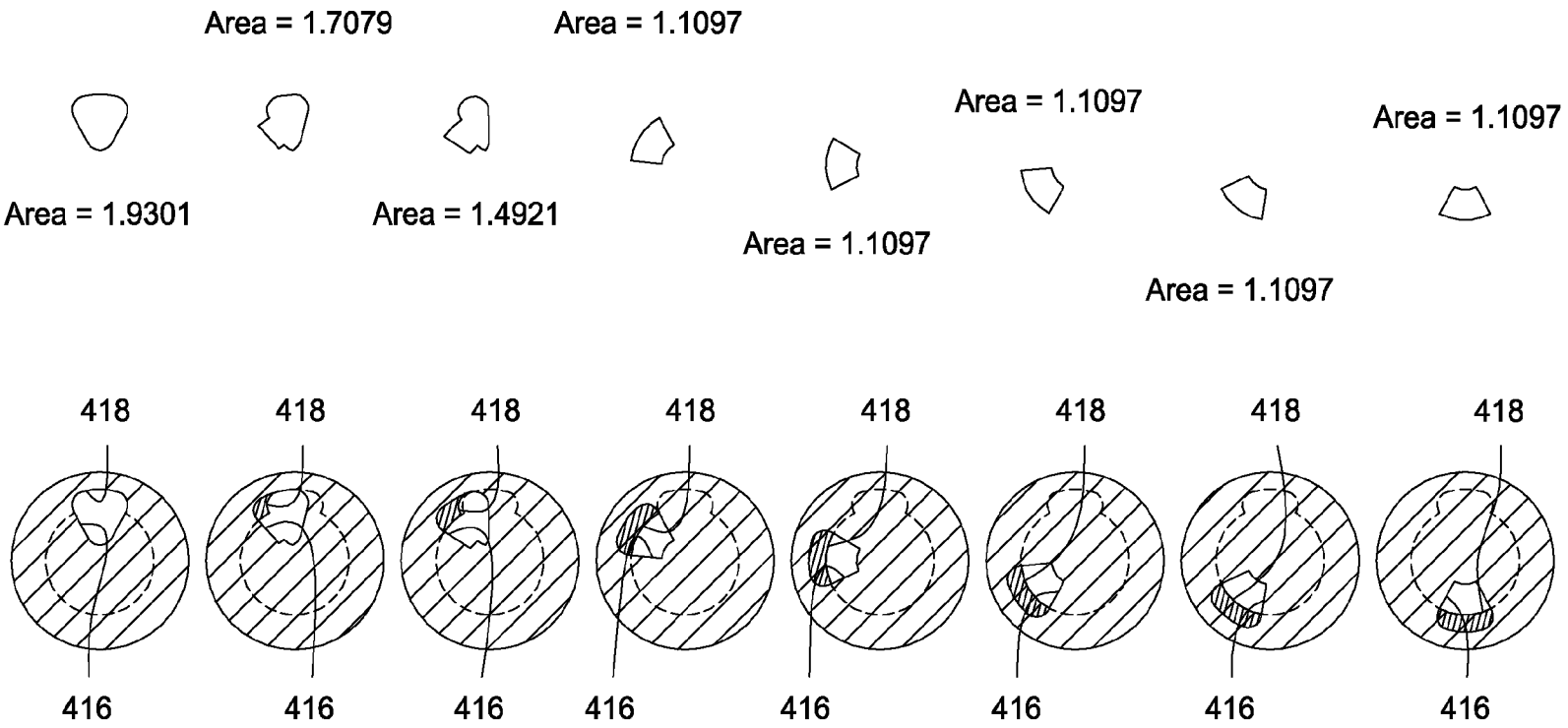
FIG. 7 illustrates progressive end views of the first and second flow channels of another exemplary orientor during orientation operations, according to one or more embodiments.

Referring now to FIG. 7, with continued reference to FIG. 6, illustrated are progressive end views of the first and second flow channels 416, 418 during an orientation operation, according to one or more additional embodiments. While the first and second flow channels 416, 418 depicted in FIG. 6 are substantially circular in shape, those skilled in the art will readily appreciate that the first and second flow channels 416, 418 may be designed or otherwise configured in various other shapes or designs. For instance, as illustrated in FIG. 7, the first flow channel 416 may be arcuate in shape or polygonal, and the second flow channel 418 may be substantially circular in shape but include an arcuate cutout portion (as shown at the top of the second flow channel 418).

By adjusting the sizing, spacing, and shape of the first and second flow channels 416, 418, the pressure profile (i.e., pressure change vs. orientation angle and/or flow area) may be correspondingly changed. In the example shown in FIG. 7, the first and second flow channels 416, 418 are designed to have a maximum flow area when aligned at the high side of the wellbore 102. As indicated above, this may prove advantageous during cementing operations where a smaller flow area may be susceptible to becoming plugged with cement pebbles or other obstruction. Accordingly, the desired pressure drop will occur when the window 104 is 180° from the low side of the wellbore 102.

In the example of FIG. 7, the pressure drop remains constant at approximately 47 psi between 60° and −60°. The pressure drop, however, decreases when the window 104 is angularly oriented between +/−60°. In a preferred embodiment, a pressure drop when the window 104 is angularly oriented to within +/−30° may be recommended.

The examples of FIGS. 6 and 7 indicate that various pressure drops can be designed by varying the flow area of the first and second flow channels 416, 418 at different angular positions. It should be noted that the above pressure drop profiles are considered "ideal" profiles, but the actual profiles may vary due to various properties and parameters including, but not limited to Reynolds number, Coanda effect, etc. In the end, however, an operator may not be required to determine or otherwise detect an exact pressure drop or rise. Rather, the operator need only observe a sudden change in pressure as the wellbore tubular 106 is rotated within the wellbore 102.

Figure 8:
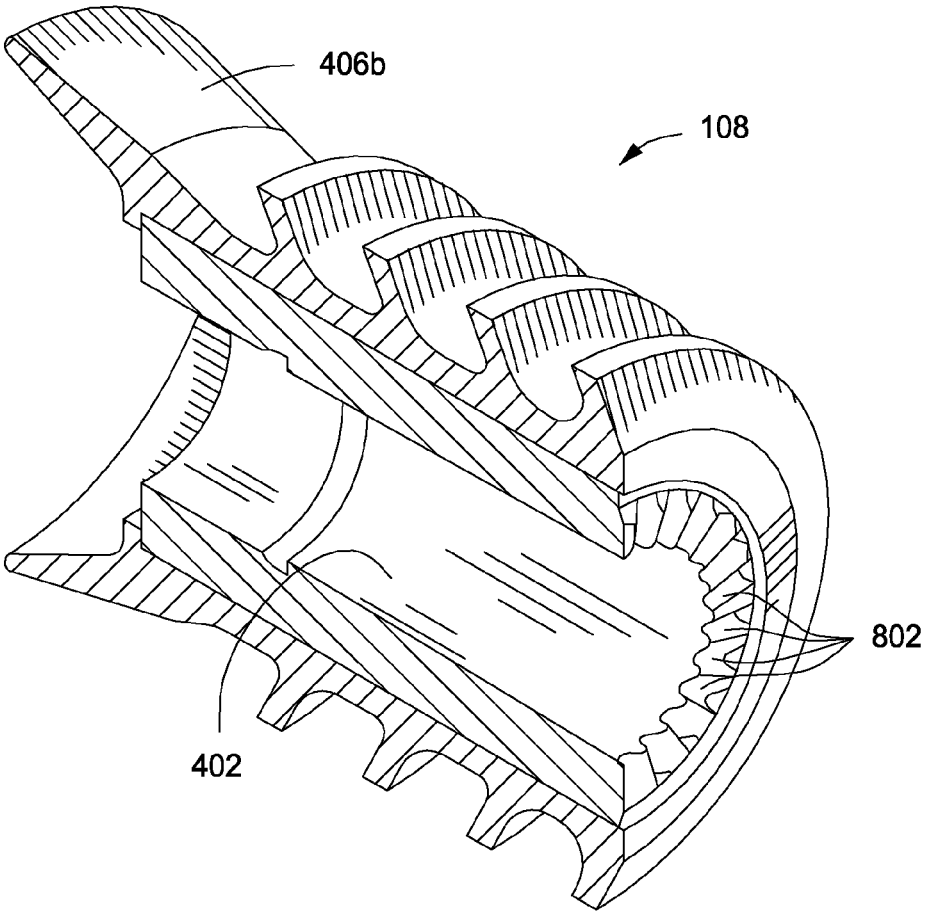
FIG. 8 illustrates an isometric cross-sectional view of a portion of an orientation indicating device, according to one or more embodiments.

Referring now to FIG. 8, with reference again to FIG. 4, illustrated is an isometric cross-sectional view of a portion of the orientation indicating device 108, according to one or more embodiments. As illustrated, a portion of the downhole end of the housing 402 is depicted as encompassed by the lower sealing device 406*b*. The orientor 404 is omitted in FIG. 8 for visibility. In some embodiments, the bottom end of the device 108 may include a series of teeth 802. More particularly, the downhole end of the housing 402 may have the teeth 802 defined thereon. In some embodiments, the teeth may be profiled edges, castellations, or serrations configured to engage or grip axially adjacent objects or structures.

In operation, the teeth 802 may prove advantageous in preventing the device 108 from rotating while being drilled up by the drill bit 142 (FIG. 3). More specifically, as described above, following the orientation operation, the device 108 may be advanced within the wellbore 102 (FIGS. 1-3) until coming into contact with the cementing valve 130 (FIGS. 1-3) or associated float collar. Following a subsequent cementing operation, the drill bit 142 is used to drill through the device 108 and the cementing valve 130. The teeth 802 may be configured to grip and otherwise engage the cementing valve 130 or its associated float collar such that the device 108 is substantially prevented from rotating within the wellbore tubular (FIGS. 1-3) and otherwise unable to be drilled through. In some embodiments, the cementing valve 130 or its associated float collar may have corresponding mating teeth or profiles to enhance the gripping engagement.

In at least one embodiment, the housing 402 may provide an axially extending nose (not shown) that extends downhole from the lower sealing device 406*b*. In such embodiments, the teeth 802 may alternatively or in addition thereto be defined on the outer radial surface of the nose and configured to radially engage mating teeth or profiles defined on an inner radial surface of the cementing valve 130. In some applications, debris or other obstructions within the wellbore 102 prevent blocking the axial teeth 802 from axially engaging the cementing valve 130. In such applications, the radially defined teeth 802 on the nose may be configured to mate with the cementing valve 130 and ensure that the device 108 is unable to rotate upon being drilled. Such radial teeth 802 may have a hexagonal or other polygonal profile configured to land in a corresponding female mating polygonal profile in the cementing valve 130 or its associated float collar.

Similar to the teeth 802 for the housing 402, in some embodiments, the orientor 404 may also have a locking profile or tooth profile on its downhole end to ensure that it also is unable to rotate while being drilled up by the drill bit 142 (FIG. 3). This may require a shear retainer to hold it in the "rotating" position until the device 108 is shear-released, as described above, and advanced to the cementing valve 130 or its associated float collar. At that point, or when a predetermined amount of weight from the drill bit 142 is applied, the orientor 404 may be configured to shear release and move to a "locked" position where it would be unable to rotate.

It may now be fully appreciated that the above disclosure provides many advancements in the art of azimuthally orienting structures in wellbores. In particular, the device 108, system 100 and associated methods provide for convenient, economical and accurate azimuthal orientation of various types of structures in deviated wellbores. One benefit of use of the device 108 is that the pressure differentials observed as indications of the orientation of the device 108 are substantially constant, instead of being in the nature of pressure pulses, which can be severely attenuated in deep wells.

Embodiments disclosed herein include:

A. An orientation indicating device that includes a housing defining a first flow channel and being arrangeable within a wellbore tubular, an orientor movably arranged within the housing and defining a second flow channel in fluid communication with the first flow channel, and an eccentric weight arranged within the orientor and having a center of mass radially offset from a rotational axis of the orientor, the eccentric weight being configured to maintain the orientor pointing in one direction as the housing and the wellbore tubular are rotated, wherein, as the housing rotates, the first and second flow channels become progressively aligned or misaligned.

B. A well system that includes a wellbore tubular extendable within a wellbore and having a downhole structure coupled thereto, an orientation indicating device arranged within the wellbore tubular and comprising, a housing defining a first flow channel and being azimuthally aligned with the downhole structure, an orientor movably arranged within the housing and defining a second flow channel in fluid communication with the first flow channel, and an eccentric weight arranged within the orientor and having a center of mass radially offset from a rotational axis of the orientor such that the eccentric weight maintains the orientor pointing to a high side of the wellbore, wherein a fluid is circulated through the wellbore tubular and the orientation indicating device as the wellbore tubular is rotated within the wellbore, and wherein, as the wellbore tubular rotates, the first and second flow channels become progressively aligned or misaligned and thereby generate a pressure differential across the orientation indicating device that can be measured to determine whether the downhole structure is moved to a desired angular orientation within the wellbore.

C. A method that includes introducing a wellbore tubular into a wellbore, the wellbore tubular having a downhole structure coupled thereto and an orientation indicating device arranged within the wellbore tubular, the orientation indicating device having a housing defining a first flow channel, an orientor movably arranged within the housing and defining a second flow channel in fluid communication with the first flow channel, and an eccentric weight arranged within the orientor and having a center of mass radially offset from a rotational axis of the orientor, maintaining the orientor pointing to a predetermined orientation of the wellbore as the eccentric weight is acted upon by gravitational forces, circulating a fluid through the wellbore tubular and the orientation indicating device, measuring a pressure differential generated across the orientation indicating device while circulating the fluid, rotating the wellbore tubular within the wellbore while circulating the fluid and thereby progressively aligning or misaligning the first and second flow channels, and measuring a change in the pressure differential across the orientation indicating device as the wellbore tubular is rotated and thereby determining if the downhole structure is moved to a desired angular orientation within the wellbore.

Each of embodiments A, B, and C may have one or more of the following additional elements in any combination: Element 1: further comprising an upper sealing device arranged at an uphole end of the housing, and a lower sealing device arranged at a downhole end of the housing, the upper and lower sealing devices being configured to sealingly engage an inner wall of the wellbore tubular. Element 2: wherein at least one of the upper and lower sealing devices is a wiper plug that provides a one or more wipers configured to engage the inner wall of the wellbore tubular. Element 3: further comprising one or more securing devices that secure the housing to the wellbore tubular at least one of axially and rotationally. Element 4: wherein the one or more securing devices comprises a tab securable to the housing, and a releasable device that secures the tab to the wellbore tubular. Element 5: further comprising a thrust bearing configured to secure the orientor against axial loads within the housing, and at least one radial bearing configured to allow the orientor to rotate about the rotational axis with respect to the housing. Element 6: wherein a cross-sectional shape of the first and second flow channels is at least one of circular, arcuate, polygonal, or any combination thereof. Element 7: wherein a downhole end of the housing has a plurality of teeth defined thereon.

Element 8: wherein the downhole structure is at least one of a window, a latch coupling, and an alignment tool. Element 9: wherein the desired angular orientation is the high side of the wellbore. Element 10: wherein the orientation indicating device further comprises an upper sealing device arranged at an uphole end of the housing, and a lower sealing device arranged at a downhole end of the housing, the upper and lower sealing devices being configured to sealingly engage an inner wall of the wellbore tubular. Element 11: further comprising a latch profile arranged on the wellbore tubular, wherein the orientation indicating device is arranged such that the latch profile axially interposes the upper and lower sealing devices. Element 12: wherein a decrease in the pressure differential across the device is an indication that the desired angular orientation has been achieved. Element 13: wherein an increase in the pressure differential across the device is an indication that the desired angular orientation has been achieved.

Element 14: wherein introducing the wellbore tubular into the wellbore is preceded by azimuthally measuring or aligning the orientation indicating device with the downhole structure. Element 15: wherein measuring the change in the pressure differential across the orientation indicating device comprises detecting a decrease in the pressure differential to indicate that the downhole structure has moved to the desired angular orientation within the wellbore. Element 16: wherein measuring the change in the pressure differential across the orientation indicating device comprises detecting an increase in the pressure differential to indicate that the downhole structure has moved to the desired angular orientation within the wellbore. Element 17: further comprising pumping a cement slurry through the orientation indicating device for a cementing operation in the wellbore, releasing the orientation indicating device from engagement with the wellbore tubular with one or more cement wiper plugs, advancing the orientation indicating device to a bottom of the wellbore, and drilling through the orientation indicating device following the cementing operation. Element 18: wherein the orientation indicating device further comprises an upper sealing device arranged at an uphole end of the housing and a lower sealing device arranged at a downhole end of the housing, the method further comprising arranging the orientation indicating device within the wellbore tubular such that the upper and lower sealing devices axially encompass a latch profile provided on an inner wall of the wellbore tubular, and engaging the inner wall of the wellbore tubular with the upper and lower sealing devices.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An orientation indicating device, comprising:

a housing defining a first flow channel and being arrangeable within a wellbore tubular;

an orientor arranged within the housing and defining a second flow channel fluidly communicable with the first flow channel, wherein the orientor is rotatable relative to the housing about a longitudinal axis of the wellbore tubular; and an eccentric weight arranged within the orientor and having a center of mass radially offset from the longitudinal axis, the eccentric weight being configured to maintain the orientor pointing in one direction as the housing and the wellbore tubular are rotated, wherein, as the housing rotates about the longitudinal axis, the first and second flow channels become progressively aligned or misaligned.

2. The device of claim 1, further comprising:

an upper sealing device arranged at an uphole end of the housing; and a lower sealing device arranged at a downhole end of the housing, the upper and lower sealing devices being configured to sealingly engage an inner wall of the wellbore tubular.

3. The device of claim 2, wherein at least one of the upper and lower sealing devices is a wiper plug that provides a one or more wipers configured to engage the inner wall of the wellbore tubular.

4. The device of claim 1, further comprising one or more securing devices that secure the housing to the wellbore tubular at least one of axially and rotationally.

5. The device of claim 4, wherein the one or more securing devices comprises:

a tab securable to the housing; and a releasable device that secures the tab to the wellbore tubular.

6. The device of claim 1, further comprising:

a thrust bearing that secures the orientor against axial loads within the housing; and at least one radial bearing that allows the orientor to rotate about the longitudinal axis with respect to the housing.

7. The device of claim 1, wherein a cross-sectional shape of the first and second flow channels is at least one of circular, arcuate, polygonal, or any combination thereof.

8. The device of claim 1, wherein a downhole end of the housing has a plurality of teeth defined thereon.

9. A well system, comprising:

a wellbore tubular extendable within a wellbore and having a downhole structure coupled thereto;

an orientation indicating device arranged within the wellbore tubular and comprising:

a housing secured within the wellbore tubular to be azimuthally aligned with the downhole structure and defining a first flow channel; and an orientor arranged within the housing and defining a second flow channel fluidly communicable with the first flow channel, wherein the orientor is rotatable relative to the housing about a longitudinal axis of the wellbore tubular; and an eccentric weight arranged within the orientor and having a center of mass radially offset from the longitudinal axis such that the eccentric weight maintains the orientor pointing to a high side of the wellbore, wherein a fluid is circulated through the wellbore tubular and the orientation indicating device as the wellbore tubular is rotated within the wellbore, and wherein, as the wellbore tubular rotates about the longitudinal axis, the first and second flow channels become progressively aligned or misaligned and thereby generate a pressure differential across the orientation indicating device that can be measured to determine whether the downhole structure is moved to a desired angular orientation within the wellbore.

10. The well system of claim 9, wherein the downhole structure is at least one of a window, a latch coupling, and an alignment tool.

11. The well system of claim 9, wherein the desired angular orientation is the high side of the wellbore.

12. The well system of claim 9, wherein the orientation indicating device further comprises:

an upper sealing device arranged at an uphole end of the housing; and a lower sealing device arranged at a downhole end of the housing, the upper and lower sealing devices being configured to sealingly engage an inner wall of the wellbore tubular.

13. The well system of claim 12, further comprising a latch profile arranged on the wellbore tubular, wherein the orientation indicating device is arranged such that the latch profile axially interposes the upper and lower sealing devices.

14. The well system of claim 9, wherein a decrease in the pressure differential across the device is an indication that the desired angular orientation has been achieved.

15. The well system of claim 9, wherein an increase in the pressure differential across the device is an indication that the desired angular orientation has been achieved.

16. A method, comprising:

introducing a wellbore tubular into a wellbore, the wellbore tubular having a downhole structure coupled thereto and an orientation indicating device arranged within the wellbore tubular, the orientation indicating device having a housing defining a first flow channel, an orientor arranged within and rotatable relative to the housing about a longitudinal axis of the wellbore tubular and defining a second flow channel fluidly communicable with the first flow channel, and an eccentric weight arranged within the orientor and having a center of mass radially offset from the longitudinal axis of the orientor;

maintaining the orientor pointing to a predetermined orientation of the wellbore as the eccentric weight is acted upon by gravitational forces;

circulating a fluid through the wellbore tubular and the orientation indicating device;

measuring a pressure differential generated across the orientation indicating device while circulating the fluid;

rotating the wellbore tubular about the longitudinal axis within the wellbore while circulating the fluid and thereby progressively aligning or misaligning the first and second flow channels; and measuring a change in the pressure differential across the orientation indicating device as the wellbore tubular is rotated and thereby determining if the downhole structure is moved to a desired angular orientation within the wellbore.

17. The method of claim 16, wherein introducing the wellbore tubular into the wellbore is preceded by azimuthally measuring or aligning the orientation indicating device with the downhole structure.

18. The method of claim 16, wherein measuring the change in the pressure differential across the orientation indicating device comprises detecting a decrease in the pressure differential to indicate that the downhole structure has moved to the desired angular orientation within the wellbore.

19. The method of claim 16, wherein measuring the change in the pressure differential across the orientation indicating device comprises detecting an increase in the pressure differential to indicate that the downhole structure has moved to the desired angular orientation within the wellbore.

20. The method of claim 16, further comprising:

pumping a cement slurry through the orientation indicating device for a cementing operation in the wellbore;

releasing the orientation indicating device from engagement with the wellbore tubular with one or more cement wiper plugs;

advancing the orientation indicating device to a bottom of the wellbore; and drilling through the orientation indicating device following the cementing operation.

21. The method of claim 16, wherein the orientation indicating device further comprises an upper sealing device arranged at an uphole end of the housing and a lower sealing device arranged at a downhole end of the housing, the method further comprising:

arranging the orientation indicating device within the wellbore tubular such that the upper and lower sealing devices axially encompass a latch profile provided on an inner wall of the wellbore tubular; and engaging the inner wall of the wellbore tubular with the upper and lower sealing devices.

* * * * *